United States Patent [19]

Oag

[11] 4,080,974

[45] Mar. 28, 1978

[54] BOTTLE CLEANING APPARATUS

[76] Inventor: Edward James Oag, 27 Young St., Wahroonga, New South Wales, Australia

[21] Appl. No.: 734,827

[22] Filed: Oct. 22, 1976

[30] Foreign Application Priority Data

Oct. 22, 1975 Australia ..... PC3671

[51] Int. Cl.[2] ..... B08B 3/02; B08B 9/08

[52] U.S. Cl. ..... 134/62; 134/68; 134/70; 134/126; 134/134; 134/152; 198/802

[58] Field of Search ..... 134/43, 62, 66–68, 134/125–129, 133–134, 152, 70; 198/377–378, 478, 802

[56] References Cited

U.S. PATENT DOCUMENTS

| | | | |
|---|---|---|---|
| 2,634,737 | 4/1953 | Rowe | 134/126 X |
| 2,900,071 | 8/1959 | Willsey | 134/125 X |
| 3,481,348 | 12/1969 | Schultz | 134/126 |
| 3,530,971 | 9/1970 | Babunovic | 198/377 |
| 3,556,847 | 1/1971 | Prodzenski | 134/62 X |
| 3,563,256 | 2/1970 | Babunovic | 134/129 X |
| 3,583,544 | 6/1971 | Prodzenski | 134/68 X |
| 3,614,958 | 10/1971 | Perrier | 134/68 X |

FOREIGN PATENT DOCUMENTS

| | | | |
|---|---|---|---|
| 1,154,502 | 11/1957 | France | 134/62 |
| 1,218,702 | 1/1971 | United Kingdom | 134/68 |

*Primary Examiner*—Robert L. Bleutge

*Attorney, Agent, or Firm*—Leydig, Voit, Osann, Mayer & Holt Ltd.

[57] ABSTRACT

A bottle cleansing apparatus having bottle cradles hingedly mounted to a first conveyor for movement of said cradles along a path and part rotation of said cradles about an axis longitudinal of said path, said cradles having a floor portion for supporting bottles presented laterally thereto in generally upstanding disposition and a roof portion with an aperture therein for supporting bottles in inverted disposition when said cradles are part-rotated, said roof portion being peaked to direct the downwardly directed mouths of the bottles into register with said apertures. Nozzles are carried on a second conveyor so as to be in register with a respective cradle aperture over a predetermined distance for injection of fluid into the bottles through their downwardly directed mouths. A rotary valve may be used for directing fluid to each nozzle only when said nozzle is in register with a bottle mouth. Means are provided for loading bottles in said cradles in generally upstanding disposition, for part rotating said cradles to invert the bottles, for part rotating said cradles to revert the bottles after indection of fluid, and for unloading bottles from said cradles in generally upstanding disposition.

12 Claims, 9 Drawing Figures

BOTTLE CLEANING APPARATUS

In the manufacture and filling of containers such as glass bottles, it is necessary to ensure that the interior of the container is appropriately clean. The most usual way of doing this is to wash the bottle with some form of cleaning liquid.

In the course of the cleaning process, the bottles generally receive a final rinsing with clean water prior to filling. Similarly, when new bottles intended for a single use are supplied to the bottler it is desirable that they should receive a final rinse before filling to ensure that no foreign material such as glass chips or slivers remain. The present invention has been developed primarily for use at this rinsing stage to inject a rinsing fluid and/or drying gas into the mouth of each bottle, but it will be appreciated that the invention is applicable to cleansing generally and is not limited to the particular application described.

According to the invention there is provided a bottle cleansing apparatus comprising a first conveyor having a series of bottle cradles hingedly mounted in spaced relation along said conveyor, each of said cradles being able to accept a generally upstanding bottle laterally presented thereto and to hold said bottle with its mouth directed downwardly upon hinged part-rotation of said cradle, means for presenting said bottles laterally to said cradles in a generally upstanding position at a loading station, means downstream of said loading station for hingedly part-rotating said cradles as aforesaid so to direct the mouth of their respective bottles downwardly, a second conveyor supporting a series of spaced nozzles each able to register with a respective downwardly directed bottle mouth over a predetermined length of said first conveyor, means for driving said first and second conveyors so to maintain said nozzles in register with said mouths over said predetermined length of said first conveyor, means for injecting a fluid through said nozzles into the mouth of said bottles as said bottles traverse said predetermined length of said first conveyor, means downstream of said predetermined length of said first conveyor for reverting said cradles such that the bottles re-assume a generally upstanding position, and means for removing said bottles from their respective cradles at an unloading station after reversion of said cradles.

Preferably, the bottles are loaded into their respective cradles by being moved sideways through an aperture in the cradle wall to rest upon a floor, the cradle is then rotated to bring the bottle mouth into register with the respective nozzle.

Preferably also, if the invention is applied to the injection of a gas such as air, means are provided to introduce each nozzle outlet into its respective bottle mouth before the gas is injected.

A preferred embodiment of the invention will now be described by way of example only with reference to the accompanying drawings in which.

Figure 1:
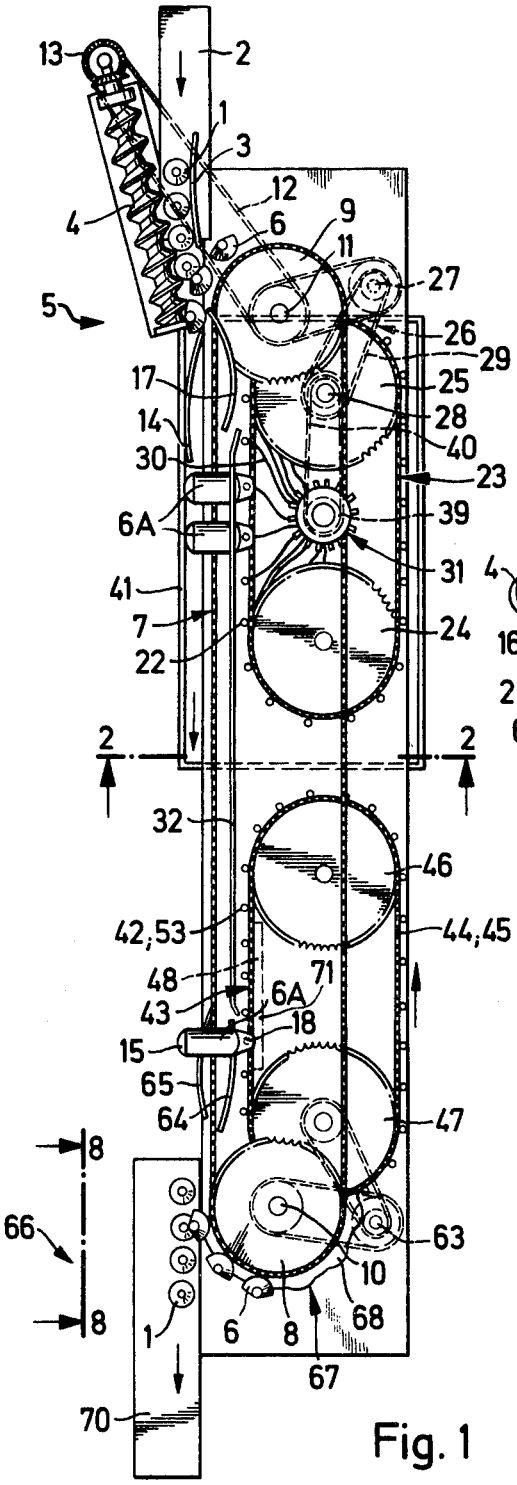
FIG. 1 is a somewhat diagrammatic plan view of a bottle rinsing machine according to the invention.
Figure 2:
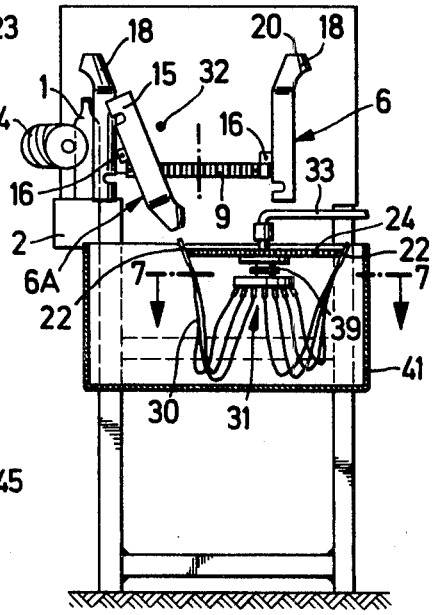
FIG. 2 is a view taken on line 2—2 of FIG. 1.
Figure 3:
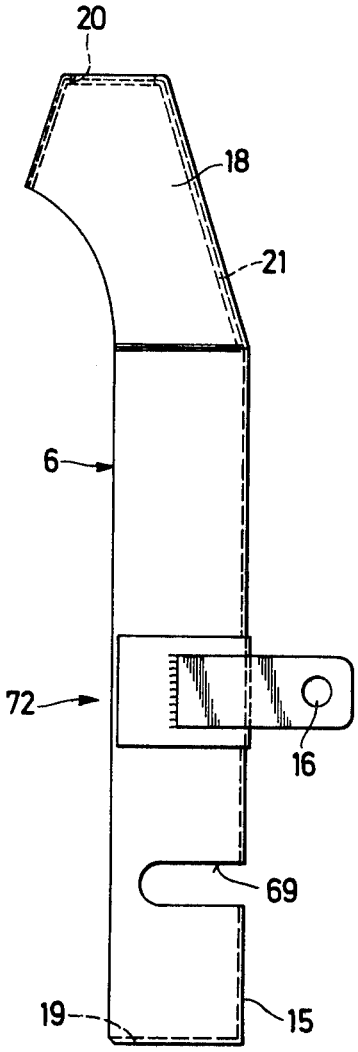
FIG. 3 is an enlarged end elevation of a cradle for use with the embodiment shown in FIGS. 1 and 2.
Figure 4:
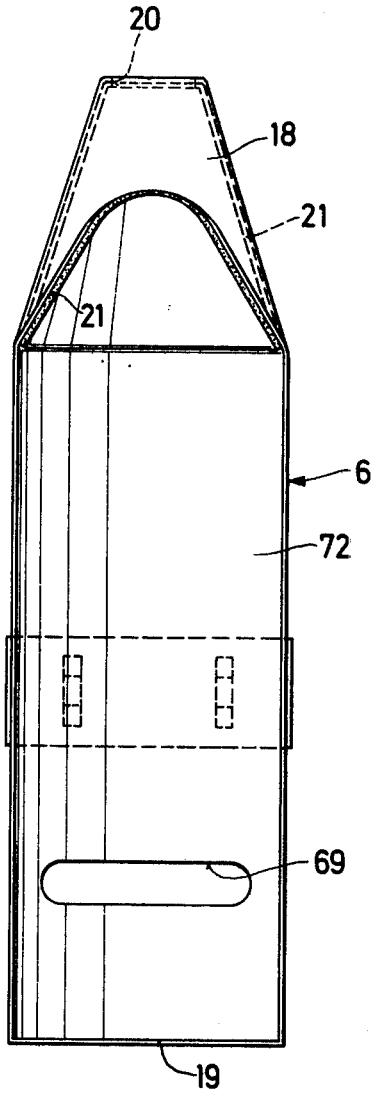
FIG. 4 is a side elevation of the cradle shown in FIG. 3.

Referring to FIGS. 1 and 2, a series of bottles 1 are fed along an input conveyor 2 in an upstanding position. The bottles may be drawn from a separate stock or travel directly from the preceding station of an integrated processing installation of which the present machine forms one part, depending upon individual requirements. As they near the end of the conveyor, the bottles are engaged by a guide rail 3 and a positioning screw 4 which spaces them apart such that they reach a loading station 5 in the correct spaced relationship to be introduced sequentially by the positioning screw 4 to a series of cradles 6 which are hingedly mounted in spaced relation along a first endless conveyor 7. The bottles are loaded into their respective cradles by being presented laterally through an aperture 72 in the cradle wall, as best shown in FIGS. 3 and 4.

The first conveyor 7 comprises an endless chain which extends between two end sprockets 8 and 9. The sprocket 8 is driven in a continuous manner through an axial shaft 10 by a conventional motor and gearbox assembly, not shown. Thus, the spaced cradles 6 are continuously carried along an endless path by said first conveyor. The drive for the positioning screw is obtained from the axial shaft 11 of sprocket 9 from which a chain drive 12 extends to a bevel gear unit 13, thereby permitting proper synchronisation of the screw and conveyor 7.

Figure 9:
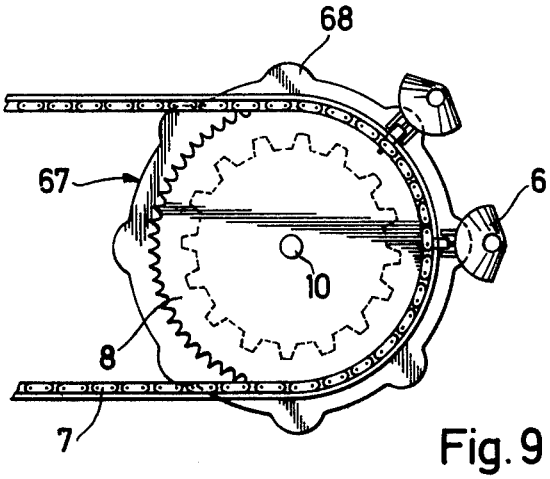
FIG. 9 is a plan view of that part of the machine illustrated in FIG. 8.

As each newly loaded bottle is conveyed away from the loading station 5, its respective cradle comes into contact with an upwardly extending cam rail 14 which successively makes contact with the lower part 15 of each cradle so as to cause part-rotation of the cradles about their hinge axis 16 such that they assume the orientation shown by cradle 6A, as best shown in FIG. 2. As shown in FIGS. 1, 2, and 9, the hinge axis 16 has a longitudinal orientation with respect to the path of the first conveyor and the direction of travel of said cradles. A guide rail 17, extending in a generally downward direction, supports the upper or peaked end 18 of the cradle during rotation.

As each cradle rotates, its respective bottle is supported by the cradle floor 19 until the bottle falls to the narrow end 18 of the cradle such that its mouth is exposed by an aperture 20 formed at the peak of the cradle. A resilient, cushioning material 21 is provided adjacent the aperture 20 to support the bottle neck and prevent damage to the bottle during inversion.

Once the inversion is complete, each cradle and its respective bottle is aligned with a nozzle 22 located on a second conveyor 23 formed by an endless chain supported by two end sprockets 24 and 25. Sprocket 25 is driven from the axial shaft 11 of sprocket 9 by a chain drive 25 which rotates countershaft 27 which in turn drives the axial shaft 28 of sprocket 25 by a chain 29. In this way, the conveyor 23 is caused to move at the same velocity as conveyor 7. Each nozzle 22 is supplied with water from a flexible hose 30 and rotary valve assembly 31 which permits water to be supplied only to those nozzles in register with a bottle mouth over a predetermined length of conveyor 7. Thus, as the bottles proceed along the conveyor 7 they are constantly supplied with rinsing water for as long as the nozzles remain in register with the botle mouths. This rinsing time may be appropriately increased or decreased by extending the length of conveyor 23 or reducing the velocity at which both conveyors 7 and 23 move. Longitudinally extending rods such as that shown at 32 may be provided to ensure that the bottles cannot fall from their cradles during the process.

Figure 7:
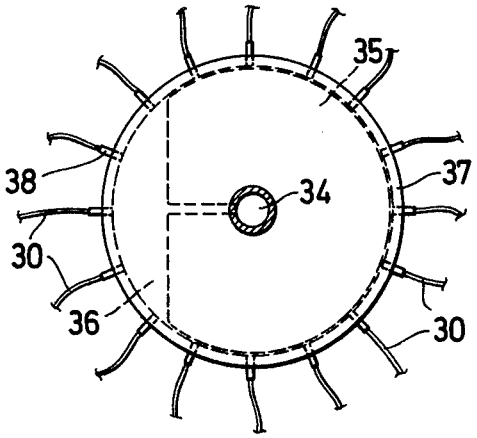
FIG. 7 is an enlarged sectional view taken on line 7—7 of FIG. 2.

The operation of the rotary valve assembly 31 can be seen from FIGS. 1, 2 and 7. Water under pressure is supplied to inlet pipe 33 from which it passes into a stationary vertical conduit 34 attached to a cylindrical member 35 having a segment removed therefrom to define a segmental chamber 36 when the cylindrical member 35 is surrounded by a rotatable sleeve member 37. Ports 38 are spaced circumferentially around the sleeve member 37 and communicate respectively with the hoses 30 and corresponding nozzles 22. The sleeve member 37 is rotated by a chain sprocket 39 driven by chain 40 from shaft 28 such that is makes one revolution for each complete cycle of conveyor 23. Thus, water admitted to chamber 36 is supplied to those nozzles at any moment in register with bottles over the predetermined length of conveyor 7. The remaining nozzles receive no water other than that which may leak past the walls of the member 35. No special sealing arrangements are made beyond normal machining tolerances and any leakage is collected in the drainage tank 41 underlying the water-jetting unit.

Figure 6:
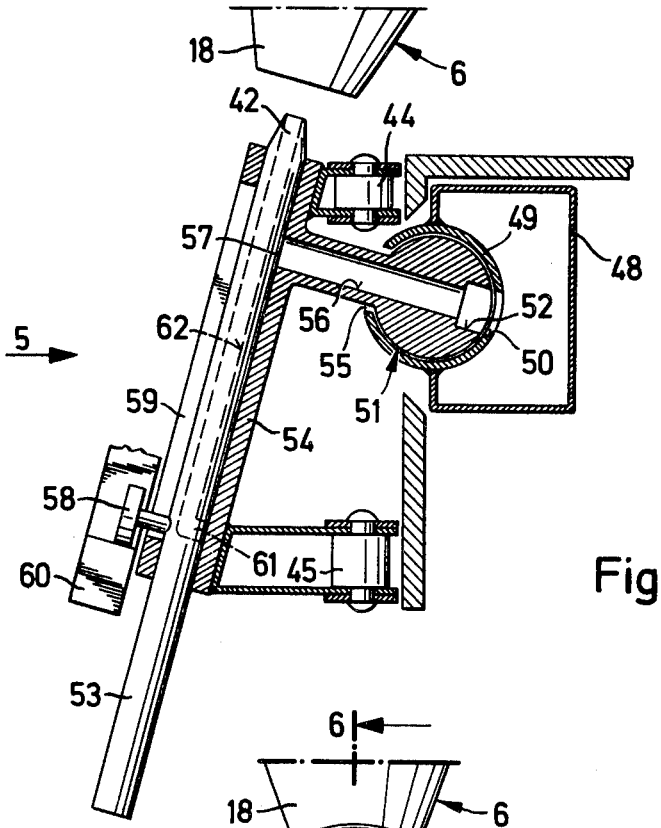
FIG. 6 is a sectional view taken on line 6—6 of FIG. 5.
Figure 5:
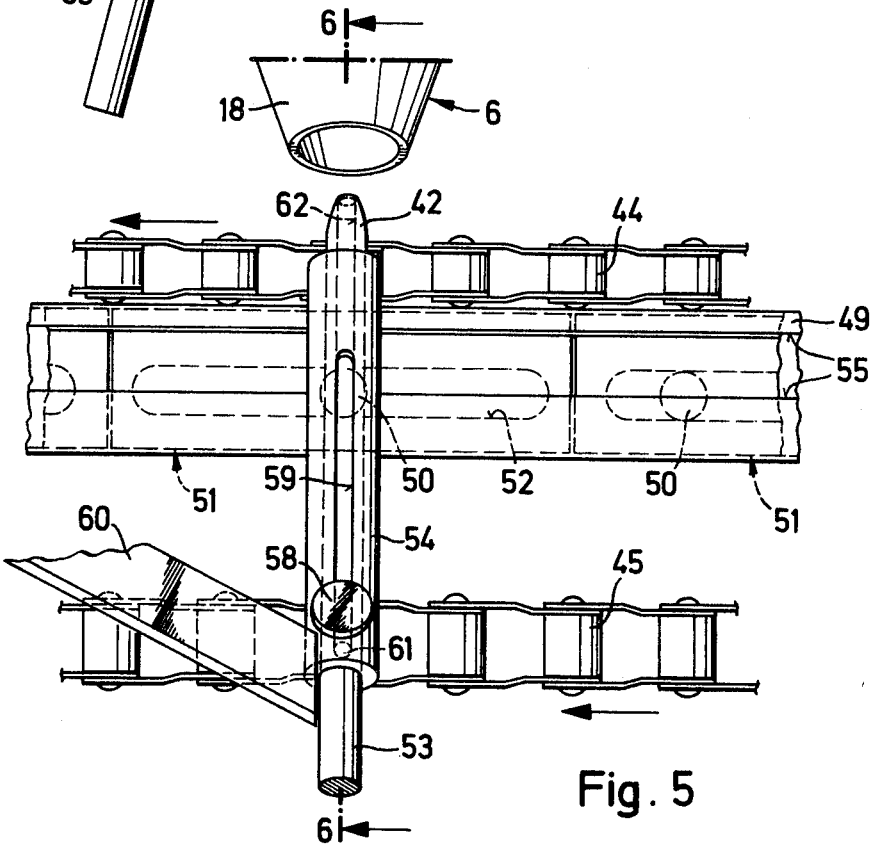
FIG. 5 is an enlarged side elevation showing the mounting arrangement of a nozzle for injecting dry air into the mouth of a bottle.

Once the nozzles 22 reach the end of their linear path and move out of register with the bottles, a draining period is provided after which the cradles come into register with a further series of nozzles 42 located on endless conveyor 43. As best shown in FIGS. 1, 5 and 6, the conveyor 43 is defined by two endless chains 44 and 45 which are supported by two pairs of end sprockets 46 and 47. The nozzles 42 are intended to inject drying air into the bottles after the cradles have traversed the draining portion of the cycle and it is desirable that each nozzle be inserted within its bottle mouth prior to the air injection. In this way, the initial flow of air will not tend to force back into the interior of the bottle any water which remains within the bottle neck after the draining period.

The location of the air injecting stage is generally indicated by reference 71 in FIG. 1 and the apparatus is illustrated in greater detail in FIGS. 5 and 6. Referring now to these drawings, air is supplied to a manifold 48 which extends parallel and adjacent to the conveyor 43. From the manifold 48, the air is admitted to a longitudinally extending cylindrical guide 49 by a series of spaced holes 50. Sliding within the guide 49 are a plurality of valving members 51, each of which contains a longitudinally extending groove 52 which is longer than the spacing between holes 50 so that air will always be supplied to the groove regardless of the position of the valving member in the guide.

Each nozzle 42 is defined by a lance 53 slidably mounted in a support tube 54 which is connected with an adjacent valving member 51 through a longitudinally extending slot 55 in guide 49. A passage 56 extends between port 57 in the support tube and groove 52 in the valving member so that the port 57 will always be in communication with the air supply in manifold 48 as the nozzles move in register with the cradles.

When it is desired to inject air into a bottle mouth, a cam follower 58 attached to lance 53 and extending through a slot 59 in support tube 54 engages with a cam 60. As the conveyor 43 moves in the direction indicated, the cam 60 forces the lance 53 along the guide tube 54 and into the mouth of a bottle supported by cradle 6. When the lance is almost fully extended a port 61 communicating with passage 62 within the lance comes into register with port 57 in the support tube thereby permitting air to flow from manifold 48, through the lance and into the bottle. Once a sufficient drying time has elapsed, the cam follower 58 comes into engagement with a further cam (not shown) which retracts the lance and thereby shuts off the air supply. The sprocket 47 of conveyor 43 is synchronously driven from the shaft 10 of sprocket 8 by a chain drive assembly through countershaft 63, thereby maintaining the nozzles 42 in register with their respective bottle mouths.

Figure 8:
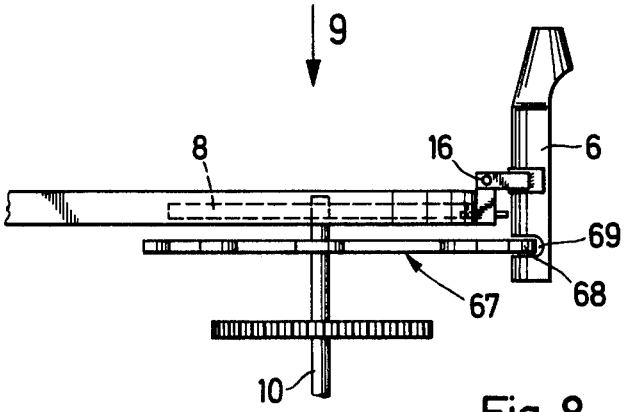
FIG. 8 is an enlarged view of part of the machine illustrated in FIG. 1 taken on line 8—8 of FIG. 1.

When the rinsing, draining and air drying is complete, the narrow end 18 of each cradle contacts an upwardly extending cam rail 64 which rotates the cradle back to an upright position. A further rail 65 extending in a generally downward direction, serves to support the lower part 15 of the cradles as they rotate. With the cradles in their upright position the bottles are removed therefrom at an unloading station 66 by an ejector wheel 67 fixedly mounted for conjoined rotation with sprocket 8 as best shown in FIGS. 8 and 9. The ejector wheel 67 carries a plurality of radially extending projections 68, circumferentially spaced around the wheel to be in register with the cradles as they approach the sprocket 8 such that each projection 68 in turn enters a slot 69 in its adjacent cradle, thereby pushing the respective bottle out of its cradle and onto a moving conveyor 70 which transports the bottles away from the machine.

It will be appreciated from the foregoing that by moving the various nozzles in register with the cradles, the washing and/or air drying time can be readily varied by slowing the velocity of movement or extending the length of the relevant conveyor. Draining time can be altered in a similar fashion. Furthermore, by uisng side loading inverting cradles as described, the apparatus is well adapted to accommodate a relatively wide variety of bottle sizes without requiring readjustment at each size change.

Although the invention has been described with reference to one specific embodiment, it will be understood that this has been included by way of example only and that the invention may be embodied in many other forms without departing from the scope of the inventive concept.

The claims defining the invention are as follows:

1. A bottle cleansing apparatus comprising:

a plurality of bottle cradles;

a first conveyor for moving said cradles along a path, said cradles being hingedly mounted to said first conveyor in spaced relation for part rotation of each said cradle about an axis longitudinal of said first conveyor path;

means along the path of said first conveyor for presenting generally upstanding bottles laterally to said cradles while said cradles are generally upright at a loading station;

each said cradle having a floor portion upon which a laterally presented generally upstanding bottle can rest while said cradle is generally upright;

means along the path of said first conveyor downstream of said loading station for hingedly part rotating said cradles about said lontitudinal axis to invert said cradles and the bottles carried therein;

each said cradle having a roof portion with an aperture therein, said roof portion being peaked so that, when said cradle and the bottle carried therein are inverted by partrotation, the mouth of the bottle is directed downwardly into register with said aperture and the bottle is supported in generally inverted deposition on said roof portion;

a plurality of nozzles for injecting a fluid through said apertures and into the downwardly directed bottle mouths after said cradles are inverted;

a second conveyor on which each said nozzle is supported for movement in register with a respective downwardly directed bottle mouth over a predetermined length of the path of said first conveyor;

means downstream of said predetermined length of the path of said first conveyor for reverting said cradles so that the bottles re-assume a generally upstanding position; and means for removing the bottles from their respective cradles at an unloading station after reversion of said cradles.

2. The bottle cleansing apparatus of claim 1 having a means for injecting pressurized fluid through said nozzle comprising a rotary valve through which the fluid passes for selectively directing the fluid to said nozzles so that fluid is directed to each said nozzle substantially only when said nozzle is in register with a respective downwardly directed bottle mouth.

3. A bottle cleansing apparatus as claimed in claim 2 wherein said fluid is water.

4. A bottle cleansing apparatus as claimed in claim 1 wherein said means for presenting said bottles laterally to said cradles includes a rotating screw having a pitch substantially equal to the spacing of said cradles and having its axis inclined with respect to the direction of travel of said cradles at said loading station thereby to urge said bottles sequentially into their respective cradles.

5. A bottle cleansing apparatus as claimed in claim 1 wherein said means for hingedly part-rotating said cradles comprises at least one cam rail against which said cradles bear as said first conveyor progresses.

6. The bottle cleansing apparatus of claim 1 having driving means for driving said first and second conveyors in a substantially continuous non-indexing motion.

7. A bottle cleansing apparatus as claimed in claim 1 wherein each of said nozzles comprises a hollow lance slidably mounted for movement along an axis substantially co-incident with that of its respective bottle when said nozzle is in register with said bottle mouth and wherein means are provided for slidably moving said lance to insert the distal end of said lance into said bottle mouth prior to the injection of said fluid and for retracting said lance after the injection has been completed.

8. A bottle cleansing apparatus as claimed in claim 7 wherein said hollow lance is slidably mounted in a sleeve and includes a port extending from its outer surface to its hollow interior, said sleeve having a corresponding port communicating with a source of pressurised fluid, said ports coming into fluid transmissive register once said distal end has been inserted a predetermined distance into said mouth.

9. A bottle cleansing apparatus as claimed in claim 8 wherein said corresponding port communicates with a cylindrical valve member slidably mounted for longitudinal movement along a corresponding chanel guide, said guide being in communication with said source of pressurised fluid through a plurality of apertures spaced therealong, said valve member communicating with at least one of said plurality of apertures at all stages of said longitudinal movement thereby to supply fluid from said source to said corresponding port.

10. A bottle cleansing apparatus as claimed in claim 7 wherein said fluid is air.

11. A bottle cleansing apparatus as claimed in claim 11 wherein a further second conveyor is provided to permit a two stage series cleansing operation, said further second conveyor being located downstream of said second conveyor.

12. A bottle cleansing apparatus as claimed in claim 11 wherein said second conveyor provides for the injection of water into said bottles and said further second conveyor provides for the injection of dry air into said bottles.

* * * * *